US005667360A

United States Patent [19]

Hauser

[11] Patent Number: 5,667,360

[45] Date of Patent: Sep. 16, 1997

[54] RADIAL IMPELLER FOR A COOLING SYSTEM OF A MOTOR VEHICLE

[75] Inventor: Kurt Hauser, Stuttgart, Germany

[73] Assignee: Behr Gmbh & Co., Germany

[21] Appl. No.: 524,789

[22] Filed: Sep. 7, 1995

[30] Foreign Application Priority Data

Sep. 7, 1994 [DE] Germany ..... 44 31 840.5

[51] Int. Cl.[6] ..... F01D 5/22

[52] U.S. Cl. ..... 416/183; 416/186 R; 416/223 B

[58] Field of Search ..... 416/183, 169 A, 416/186 R, 241 A, 223 B

[56] References Cited

U.S. PATENT DOCUMENTS

| | | | |
|---|---|---|---|
| 2,160,667 | 5/1939 | McMahan . | |
| 2,441,411 | 5/1948 | Hagen . | |
| 3,257,071 | 6/1966 | Harris | 416/186 R X |
| 3,918,841 | 11/1975 | Kida et al. | 416/183 |
| 4,211,514 | 7/1980 | Hawes | 416/186 R |
| 4,218,190 | 8/1980 | Nishikawa et al. | 416/186 R |
| 4,647,271 | 3/1987 | Nagai et al. | 416/186 R |
| 5,478,201 | 12/1995 | Amr | 416/186 R |

FOREIGN PATENT DOCUMENTS

| | | | |
|---|---|---|---|
| 0 516 073 | 12/1992 | European Pat. Off. . | |
| 397 702 | 5/1909 | France . | |
| 462 853 | 7/1928 | Germany | 416/183 |
| 906 975 | 7/1951 | Germany . | |
| 906 975 | 3/1954 | Germany . | |
| 1 503 593 | 4/1970 | Germany . | |
| 25 30 7742 | 1/1977 | Germany . | |
| 35 20 218 | 12/1985 | Germany . | |
| 258 839 | 8/1988 | Germany . | |
| 57-198396 | 12/1982 | Japan | 416/183 |
| 317 238 | 12/1956 | Switzerland . | |
| 414593 | 8/1934 | United Kingdom . | |
| 580119 | 8/1946 | United Kingdom . | |
| 1 141 198 | 12/1969 | United Kingdom . | |

*Primary Examiner*—John T. Kwon

*Attorney, Agent, or Firm*—Evenson, McKeown, Edwards & Lenahan P.L.L.C.

[57] ABSTRACT

A fan for a cooling system of a motor vehicle has a closed impeller with a plurality of radial vanes, each of which is provided with an essentially radially oriented vane base. The radial vanes extend in a generally radial direction with respect to an axis of rotation of the impeller. An inner contour of the vanes is defined by leading edges of the vanes, and an outer contour of the vanes being defined by trailing edges of the vanes. The exterior diameter of the outer contour of the radial vanes and the interior diameter of the inner contour of the radial vanes decrease in a direction from the cover disk toward the impeller bottom.

19 Claims, 4 Drawing Sheets

Fig.5
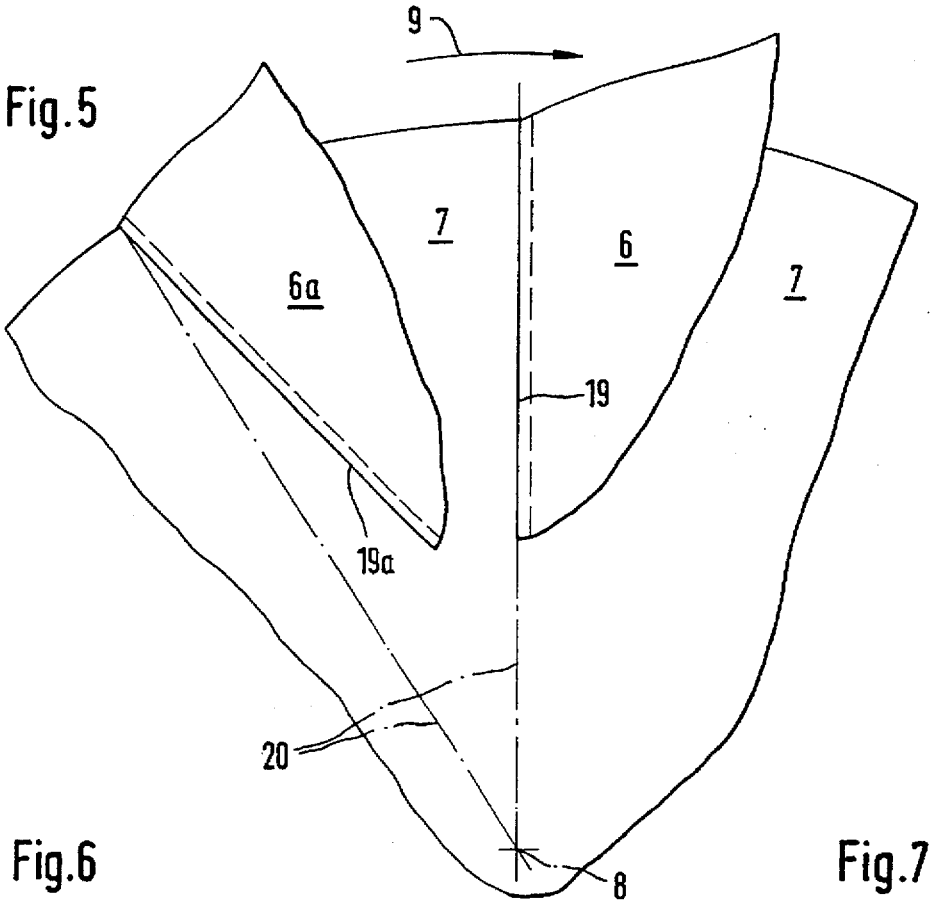
Fig.6
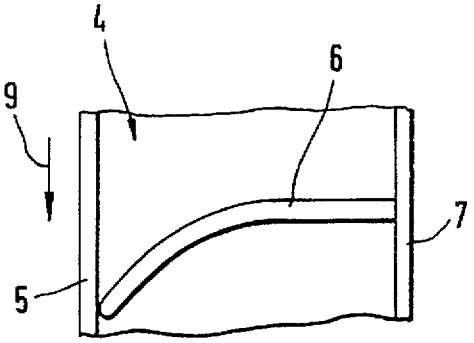
Fig.7
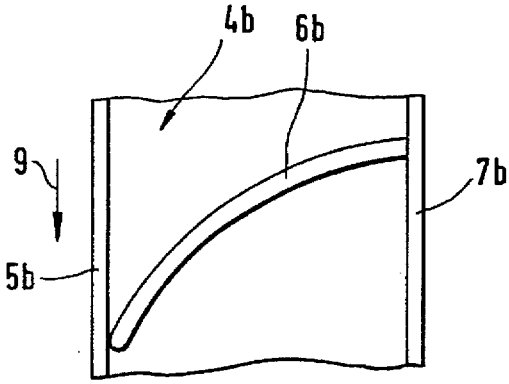
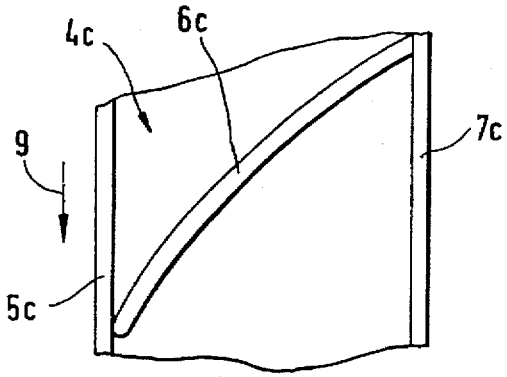
Fig.8

RADIAL IMPELLER FOR A COOLING SYSTEM OF A MOTOR VEHICLE

BACKGROUND AND SUMMARY OF THE INVENTION

The invention relates to a fan for a cooling system of a motor vehicle with a closed impeller having several radial vanes disposed between an impeller bottom and a cover disk, wherein the inner contour of the radial vanes is defined by their vane leading edges and the outer contour of the radial vanes by their vane trailing edges.

A fan for a cooling system of a motor vehicle is known from. German Patent Publication DE 25 30 742 C3, which has a radial impeller disposed, viewed in the direction of air flow, in back of a heat exchanger of a coolant circuit of the cooling system of the motor vehicle. The radial impeller is embodied to be closed and has a plurality of radial vanes disposed between a cover disk and an impeller bottom. The radial impeller is driven via an interposed friction clutch when the vehicle is stopped or moving slowly in order to assure a sufficient flow through the heat exchanger even without a sufficient air flow from movement of the vehicle. The inner contour of the radial vanes is defined by the vane leading edges extending parallel with respect to the axis of rotation, the outer contour by vane trailing edges extending correspondingly parallel.

It is an object of the present invention to provide a fan of the above-mentioned type which is improved with respect to its sturdiness and is designed advantageously with respect to flow technology.

These and other objects have been attained according to preferred embodiments of the invention by providing a fan for a cooling system of a motor vehicle with a closed impeller having a plurality of radial vanes disposed between an impeller bottom and a cover disk, the radial vanes extending in a generally radial direction with respect to an axis of rotation of the impeller, an inner contour of the vanes being defined by leading edges of the vanes and an outer contour of the vanes being defined by trailing edges of the vanes, wherein each of an exterior diameter of the outer contour of the radial vanes and an interior diameter of the inner contour of the radial vanes decrease in a direction from the cover disk toward the impeller bottom.

The bending moment caused by centrifugal forces acting on the radial vanes impairs the sturdiness of the vanes, and is reduced by orienting the radial vanes essentially in the radial direction. Furthermore the air flow against the radial vanes is improved by orienting the vanes in this manner. In comparison with the prior art, approximately the same advantageous air flow rate is achieved.

In one preferred embodiment of the invention, the vane bases of the radial vanes are inclined opposite to the direction of rotation. Preferably the inclination is less than 30° with respect to the radial direction. The flow losses in the vane channel are reduced by the inclination of the radial vanes.

In a further advantageous embodiment of the invention, a plurality of auxiliary vanes are disposed on a curved cover disk intake, distributed over its circumference, which project into the area of the radial vanes and extend across the radial height of the curved cover disk intake. As a result, the flow conditions are improved, in particular in the cover disk intake forming the outer wall between the cover disk and the intake nozzle. An improved aspirating flow is achieved.

In a further advantageous embodiment of the invention, the auxiliary vanes are inclined opposite to the direction of rotation of the radial impeller and/or curved in the direction of rotation. This embodiment leads to a reduction of the flow losses in the area of the cover disk intake.

In a further advantageous embodiment of the invention, the cover disk, the vanes and the impeller bottom are made in one piece of a plastic material, and a separate air guide ring, which interacts with a stationary intake nozzle, is provided in the area of the cover disk intake. Because of an unmolding requirement from an appropriate injection molding tool, it is not possible, when the radial impeller is made of a plastic material, to also produce the curved cover disk intake in one piece with the impeller. In order to achieve satisfactory flow conditions in spite of this, a separate air guide ring has been provided in a simple manner.

In a further embodiment of the invention, the radial vanes are curved in the direction of rotation of the radial impeller with a constant radius of curvature with respect to the radial vane extension, respectively beginning at a vane base starting from the impeller bottom. This makes possible the removal of the sucker pins when the radial impeller is made of a plastic material.

Other objects, advantages and novel features of the present invention will become apparent from the following detailed description of the invention when considered in conjunction with the accompanying drawings.

BRIEF DESCRIPTION OF THE DRAWINGS

FIG. 5 is a schematic top view of the impeller bottom in the direction of the arrow V in FIG. 1;

FIG. 6 is a portion of a top view of a radial vane in accordance with FIGS. 1, 2 or 4 in the direction of the arrows VI in the drawing figures, from which the curvature of the radial vanes in the direction of rotation of the radial impeller can be seen;

FIG. 7 is a representation similar to that of FIG. 6, wherein the radial vanes are provided with a curvature which is constant over the width of the radial impeller; and FIG. 8 is a further representation similar to that in FIGS. 6 and 7, wherein the radial vanes extend approximately radially between the impeller bottom and the cover disk.

DETAILED DESCRIPTION OF THE DRAWINGS

Figure 1:
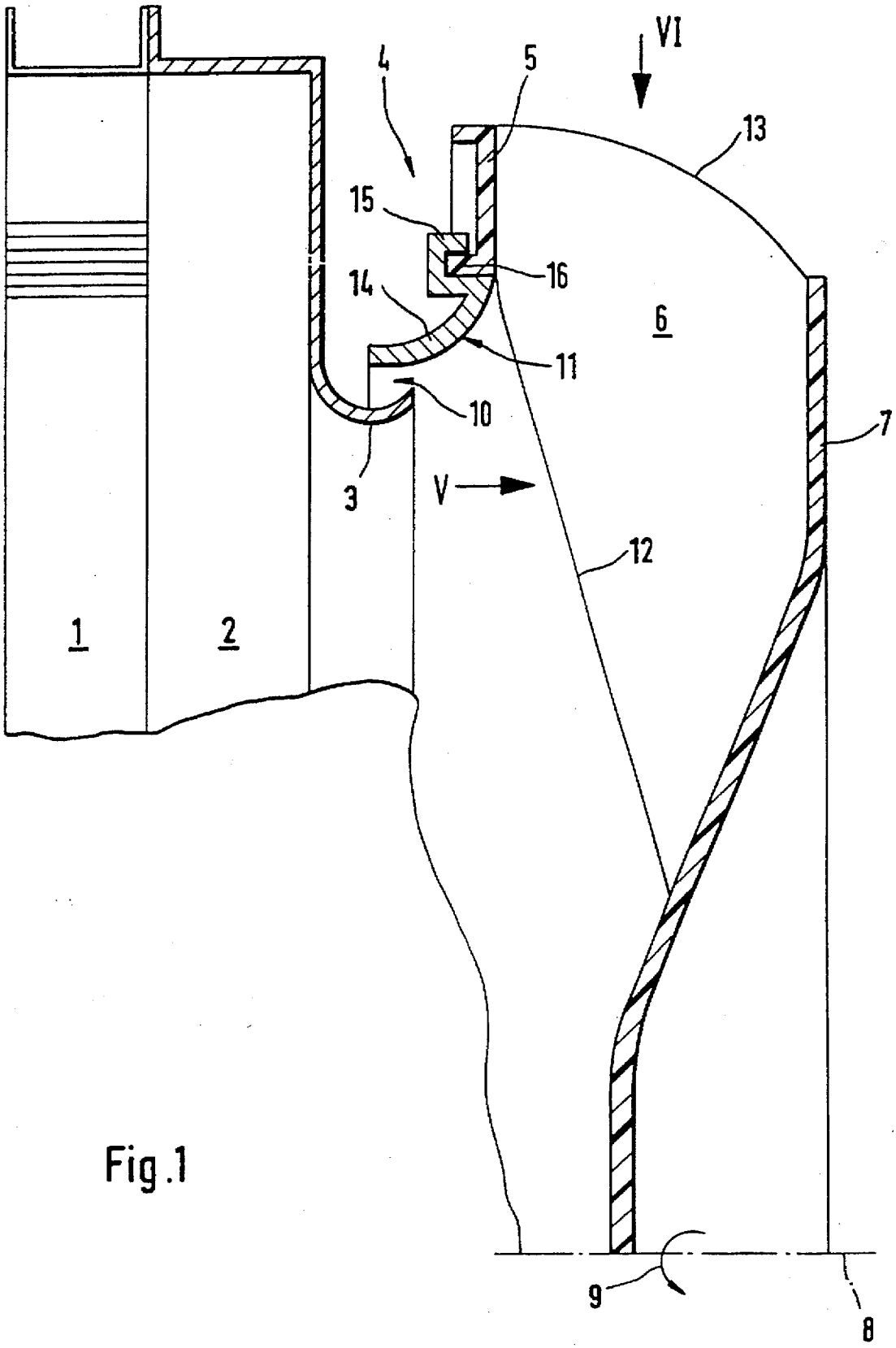
FIG. 1 is a longitudinal section of a fan constructed in accordance with a preferred embodiment of the invention.

A fan in accordance with FIG. 1 is intended for a cooling system of a motor vehicle. The cooling system has a heat exchanger (1) behind which, viewed in the direction of flow of the cooling air, a radiator cover (2) is provided. The radiator cover (2) has on its side opposite the heat exchanger (1) a stationary intake nozzle (3) which axially projects into a radial impeller (4) of the fan. The radial impeller (4) is rotatably seated around an axis of rotation (8) with the interposition of a fluid friction clutch, not shown, and can be driven in the direction of rotation (9) by means of an appropriate drive. The radial impeller (4) is closed and has a cover disk (5) and a disk-shaped impeller bottom (7), between which a plurality of radial vanes (6) are disposed distributed over the circumference. The radial vanes (6, 6*a*, 6*b*, 6*c*) in accordance with FIGS. 1 to 8 are essentially oriented in the radial direction. The cover disk (5) is provided with a cover disk intake (11) having a curved intake radius, which partially extends axially over the intake nozzle (3) of the radiator cover (2), forming a radial air gap (10).

The fan is made of a plastic material. In this case the cover disk (5), the radial vanes (6) and the impeller bottom (7) are made in one piece as a molded plastic piece. The cover disk intake (11) could not be unmolded if it had been made in one piece with the cover disk (5) in the same plastic construction as the radial impeller (4), so that the cover disk intake (11) of the advantageous embodiment represented is constituted by a separate air guide ring (14). In a preferred embodiment the air guide ring (14) is made of magnesium, or another material with increased density and rigidity, and has a support collar (15), which radially overlaps the outside of a corresponding fastening collar (16) of the cover disk (5). The inner wall of the air guide ring (14) is curved to correspond with the radius of curvature of the cover disk intake in such a way that advantageous inflow conditions for the gap flow through the air gap (10) and for the main flow result, and the flow from the cover disk intake (11) not disturbed. The entire curvature of the cover disk intake (11) is formed by the air guide ring (14), so that the inner wall of the cover disk (5) which adjoins the air guide ring (14) in an aligned manner merely extends radially flat toward the outside. The air guide ring (14) is rigidly connected with the cover disk (5).

Each radial vane (6) has a vane leading edge (12) in the area of the entry of the flow into the radial impeller (4) and a vane trailing edge (13) in the area of the exit of the flow from the radial impeller (4). Thus, the vane leading edges (12) define the inner contour and the vane trailing edges (13) the outer contour of the radial vanes (6). Because of the one-piece plastic embodiment, each radial vane (6) is connected with the cover disk (6) as well as with the impeller bottom (7). The lateral edge of each radial vane (6) adjoining the impeller bottom (7) is identified as the vane base (19) (FIG. 5). The vane bases (19) of all radial vanes (6, 6*a*, 6*b*, 6*c*) are oriented along a radial line (20) in respect to the axis of rotation (8) and project perpendicularly from the impeller bottom (7). In their progression in the direction of the cover disk (5), each radial vane (6) is curved in the direction of rotation (FIG. 6).

In the other preferred embodiments shown in FIGS. 7 and 8, the radial vanes (6*b* or 6*c*) are also curved in the direction of rotation (9). In the embodiment shown in FIG. 7, a constant radius of curvature starting perpendicularly to the impeller bottom is provided between the impeller bottom (7*b*) and the cover disk (5*b*). In the embodiment shown in FIG. 8 each radial vane (6*c*) starts at an acute angle at the impeller bottom (7*c*) and extends approximately diagonally with respect to the cover disk (5*c*).

In the schematic view of FIG. 5, a further advantageous embodiment of a radial impeller is shown, which has radial vanes (6*a*) inclined with respect to the radial line (20). Each radial vane (6*a*) has a vane base (19*a*) which is inclined opposite to the direction of rotation (9) at an acute angle of maximally approximately 30° with respect to the radial line (20). According to this embodiment, flow losses in the fan are further reduced.

The bending stress caused by the centrifugal forces in the radial vanes is reduced to a very large degree by the essentially radial orientation of the radial vanes, because of which a considerably increased sturdiness of the radial impeller and therefore higher impeller rpm are achieved.

With the radial impeller (4) in accordance with FIG. 1, the vane leading edge (12) is essentially drawn from the joint between the cover disk (5) and the cover disk intake (11) in a straight line obliquely toward the interior and toward the back to the impeller bottom. The vane trailing edge (13) of each vane (6) also extends, starting at the cover disk (5), toward the impeller bottom (7) radially curved obliquely toward the interior and axially obliquely toward the back. The exterior diameter of the cover disk (5) is greater than the exterior diameter of the impeller bottom (7). The exterior diameter of the impeller bottom (7) preferably is 70% to 80% of the exterior diameter of the cover disk (5). Accordingly, the exterior diameter of the vane trailing edge (13) continuously decreases over the width of the radial vane (6) starting from the cover disk (5) to the impeller bottom (7).

Figures 2, 3:
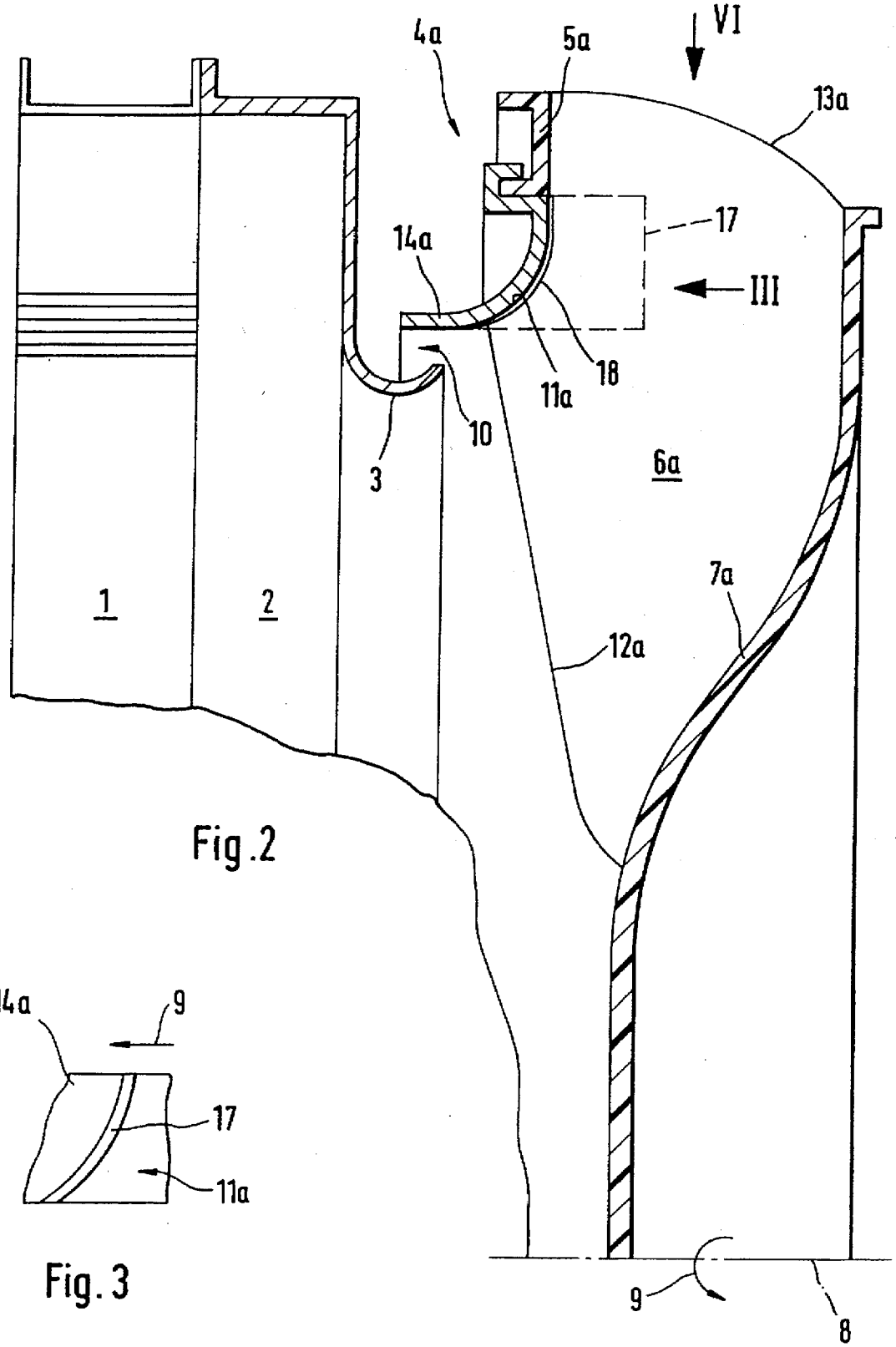
FIG. 2 represents a further embodiment of a fan similar to that of FIG. 1 having a plurality of auxiliary vanes in the area of the cover disk intake.
FIG. 3 is a view of a section of the cover disk intake in FIG. 2 in the direction of the arrow III in FIG. 2.

Without sacrificing sturdiness, the radial impeller (4*a*) in FIG. 2 has improved flow conditions in comparison with the radial impeller (4) of FIG. 1. The radial impeller (4*a*) is also made of a plastic material. Each radial vane (6*a*) has a vane leading edge (12*a*) which essentially extends straight, corresponding to the vane leading edge (12) in FIG. 1, and obliquely downward and toward the back to the impeller bottom. The curvature of the vane trailing edge (13*a*) essentially corresponds to the vane trailing edge (13) in FIG. 1. Since the cover disk intake (11*a*) is embodied as a separate air guide ring (14*a*), which is placed on the cover disk (5*a*) following the manufacture of the radial impeller (4*a*), the radial vane (6*a*) is separated from the air gap ring (14*a*) in the area of the cover disk intake (11*a*). For this purpose the radial vane (6*a*) has an air guide edge (18) which is curved to correspond to the curvature of the cover disk intake (11*a*). The air guide edge (18) starts radially outside at the height of the transition between the cover disk (5*a*) and the air guide ring (14*a*) and is drawn over nearly the entire radius of curvature of the cover disk intake (11*a*) along the inner wall of the air guide ring (14*a*) forward to the flow intake.

The radial impeller (4*a*) has a number of auxiliary vanes (17) (FIGS. 2 and 3), which correspond to the number of the radial vanes (6*a*), for improving the flow conditions in the area of the air gap (10). In an advantageous embodiment, not further shown, the number of the auxiliary vanes is considerably greater than that of the radial vanes. Each auxiliary vane (17) extends axially from the inner wall of the air guide ring (14*a*) into the area of the radial vanes (6*a*) and is curved opposite the direction of rotation (9) of the radial impeller (4*a*). Each auxiliary vane (17) extends radially between the inner diameter of the air guide ring (14*a*) and the interior diameter of the cover disk (5*a*). Each auxiliary vane (17) extends axially between the radial vanes (6*a*) by approximately one quarter to approximately one half of the distance between the impeller bottom (7*a*) and the cover disk (5*a*).

Figure 4:
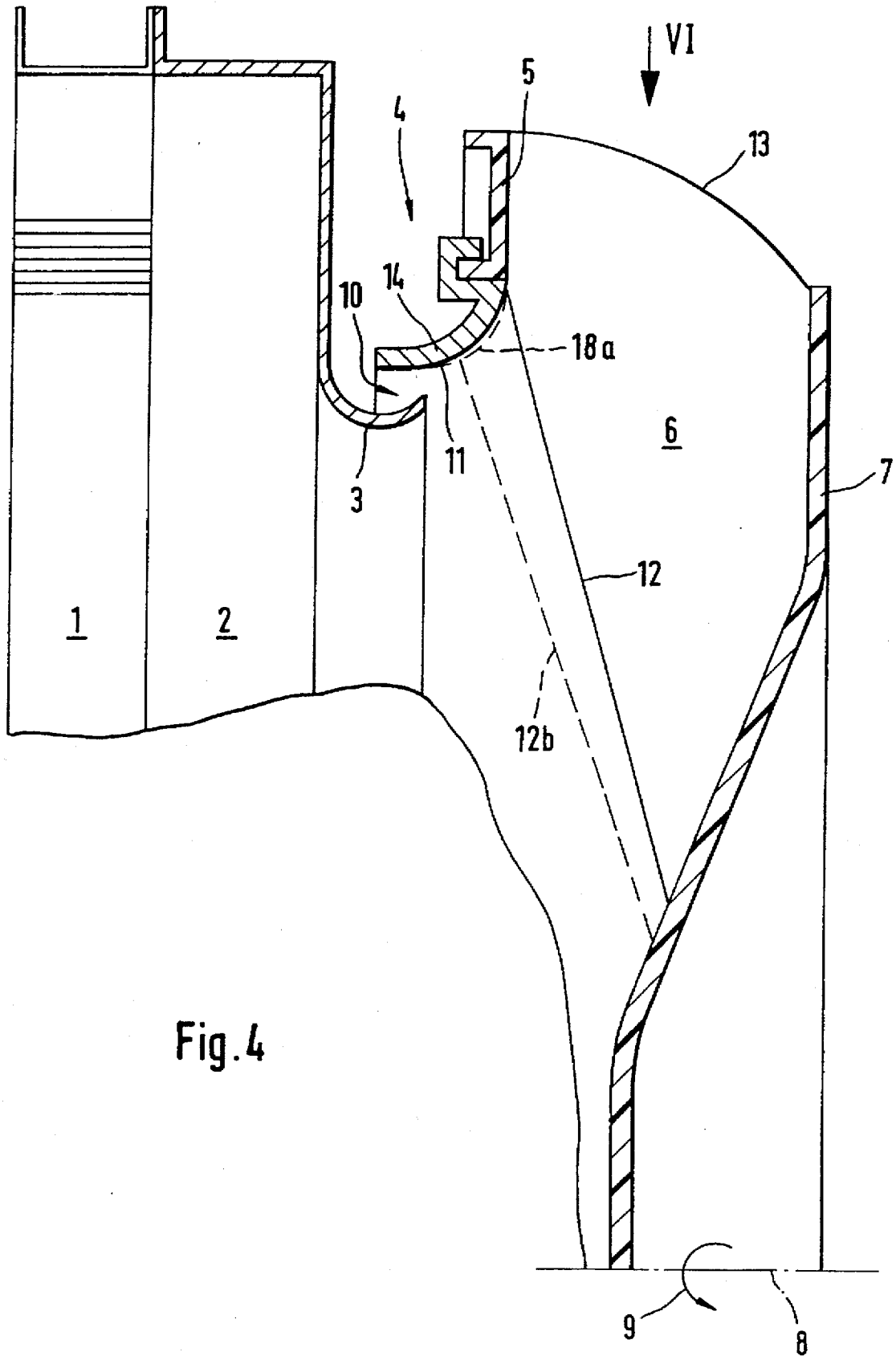
FIG. 4 is a further embodiment of a fan similar to that of FIG. 1, wherein the vane leading edge of each radial vane has been moved forward as far as the curved area of the cover disk intake.

The radial impeller (4) in FIG. 4 corresponds to the radial impeller (4) in FIG. 1. However, this radial impeller (4) has a vane leading edge (12*b*) drawn forward toward the flow intake, shown in dashed lines, which starts at approximately half the length of the radius of curvature of the cover disk intake (11) approximately perpendicularly to the inner wall of the air guide ring (14) and, in the representation of FIG. 4, extends straight obliquely toward the inside and axially toward the back as far as the impeller bottom (7). Since in this advantageous embodiment the air guide ring (14) is separated from the cover disk (5), the edge of each radial vane (6) adjoining the cover disk (5) is provided with a leading edge (18*a*), which has been drawn parallel with the inner wall of the disk cover intake (11), starting from the inner diameter of the cover disk (5), to the front toward the air gap (10). This results in an improved flow on the vane leading edge (12*b*) in the area of the air flowing along the curved cover disk intake (11), which is aspirated through the air gap (10).

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A radial impeller for a cooling system of a motor vehicle, said impeller being closed and having a plurality of radial vanes disposed between an impeller bottom and a cover disk, the radial vanes extending in a generally radial direction with respect to an axis of rotation of the impeller, an inner contour of the vanes being defined by leading edges of the vanes and an outer contour of the vanes being defined by trailing edges of the vanes, wherein each of an exterior diameter of the outer contour of the radial vanes and an interior diameter of the inner contour of the radial vanes decrease in a direction from the cover disk toward the impeller bottom, and wherein a plurality of auxiliary vanes are disposed around a circumferential area of a curved cover disk intake, and are arranged to project into the area of the radial vanes and extend over the radial length of the curved cover disk intake.

2. A radial impeller according to claim 1, wherein the diameter of the outer contour of the radial vanes decreases less than the diameter of the inner contour of the radial vanes.

3. A radial impeller according to claim 2, wherein the vane trailing edges extend in a curved path and the vane leading edges extend essentially straight between the cover disk and the impeller bottom.

4. A radial impeller according to claim 3, wherein bases of the radial vanes are inclined opposite to a direction of rotation of the impeller.

5. A radial impeller according to claim 1, wherein the auxiliary vanes are inclined opposite a direction of rotation of the impeller.

6. A radial impeller according to claim 5, wherein the number of auxiliary vanes is at least equal to the number of the radial vanes.

7. A radial impeller according to claim 5, wherein auxiliary vanes project away from the air guide ring and are rigidly connected therewith.

8. A radial impeller according to claim 5, wherein the auxiliary vanes are curved in the direction of rotation of the impeller.

9. A radial impeller according to claim 1, wherein the vane leading edge of each radial vane extends from an area of a radius of curvature of a cover disk intake.

10. A radial impeller according to claim 1, wherein the auxiliary vanes are curved in a direction of rotation of the impeller.

11. A radial impeller according to claim 1, wherein the vane leading edge of each radial vane extends from an area of a radius of curvature of the cover disk intake.

12. A radial impeller according to claim 1, wherein the cover disk, the vanes and the impeller bottom are made in one piece of a plastic material.

13. A radial impeller for a cooling system of a motor vehicle, said impeller being closed and having a plurality of radial vanes disposed between an impeller bottom and a cover disk, the radial vanes extending in a generally radial direction with respect to an axis of rotation of the impeller, an inner contour of the vanes being defined by leading edges of the vanes and an outer contour of the vanes being defined by trailing edges of the vanes, wherein each of an exterior diameter of the outer contour of the radial vanes and an interior diameter of the inner contour of the radial vanes decrease in a direction from the cover disk toward the impeller bottom, and wherein the cover disk, the vanes and the impeller bottom are made in one piece of a plastic material and wherein a separate air guide ring adjacent a stationary intake nozzle is provided in the area of a cover disk intake.

14. A radial impeller according to claim 13, wherein the air guide ring is provided with a radius of curvature adapted to a radius of curvature of the cover disk intake.

15. A radial impeller according to claim 14, wherein the air guide ring is rigidly connected with the cover disk by a support collar which engages a collar of the cover disk.

16. A radial impeller according to claim 14, wherein the radial vanes are curved with respect to the radial extension of the vanes, starting at a vane base at the impeller bottom, with a constant radius of curvature in a direction of rotation of the impeller.

17. A radial impeller according to claim 15, wherein the air guide ring is made of a material with a higher density than the plastic material.

18. A radial impeller according to claim 17, wherein the material is magnesium.

19. A radial impeller according to claim 13, wherein auxiliary vanes project away from the air guide ring and are rigidly connected therewith.

* * * * *